United States Patent [19]

Jartoux

[11] Patent Number: 4,606,380

[45] Date of Patent: Aug. 19, 1986

[54] PRESTRESS CONDUITS

[75] Inventor: Pierre Jartoux, Epernon, France

[73] Assignee: Freyssinet International Stup, Boulogne-Billancourt, France

[21] Appl. No.: 741,037

[22] Filed: Jun. 4, 1985

Related U.S. Application Data

[63] Continuation of Ser. No. 496,987, May 23, 1983, abandoned.

[30] Foreign Application Priority Data

May 21, 1982 [FR] France ..... 82 08902

[51] Int. Cl.[4] ..... E04C 5/10

[52] U.S. Cl. ..... 138/122; 52/230; 138/134

[58] Field of Search ..... 72/50; 138/122, 134, 138/135, 146; 52/230

[56] References Cited

U.S. PATENT DOCUMENTS

| | | | |
|---|---|---|---|
| 3,015,969 | 1/1962 | Bratz | 138/122 X |
| 3,114,987 | 12/1963 | Harris | 52/230 |
| 3,359,822 | 12/1967 | Hurlow | 138/134 X |

*Primary Examiner*—Stephen Marcus
*Assistant Examiner*—Mark Thronson
*Attorney, Agent, or Firm*—Cushman, Darby & Cushman

[57] ABSTRACT

To manufacture a bent prestress conduit (5) adapted to receive without damage cables (7) subjected to extremely high pulling forces, one of the faces of a metal strip (1) is coated intimately with a metal phosphate layer (4) itself covered by a soap and this metal strip is wound in helical form so as to obtain a continuous tube whose inner face is formed by the thus coated face of the metal strip.

2 Claims, 2 Drawing Figures

PRESTRESS CONDUITS

Figure 1:
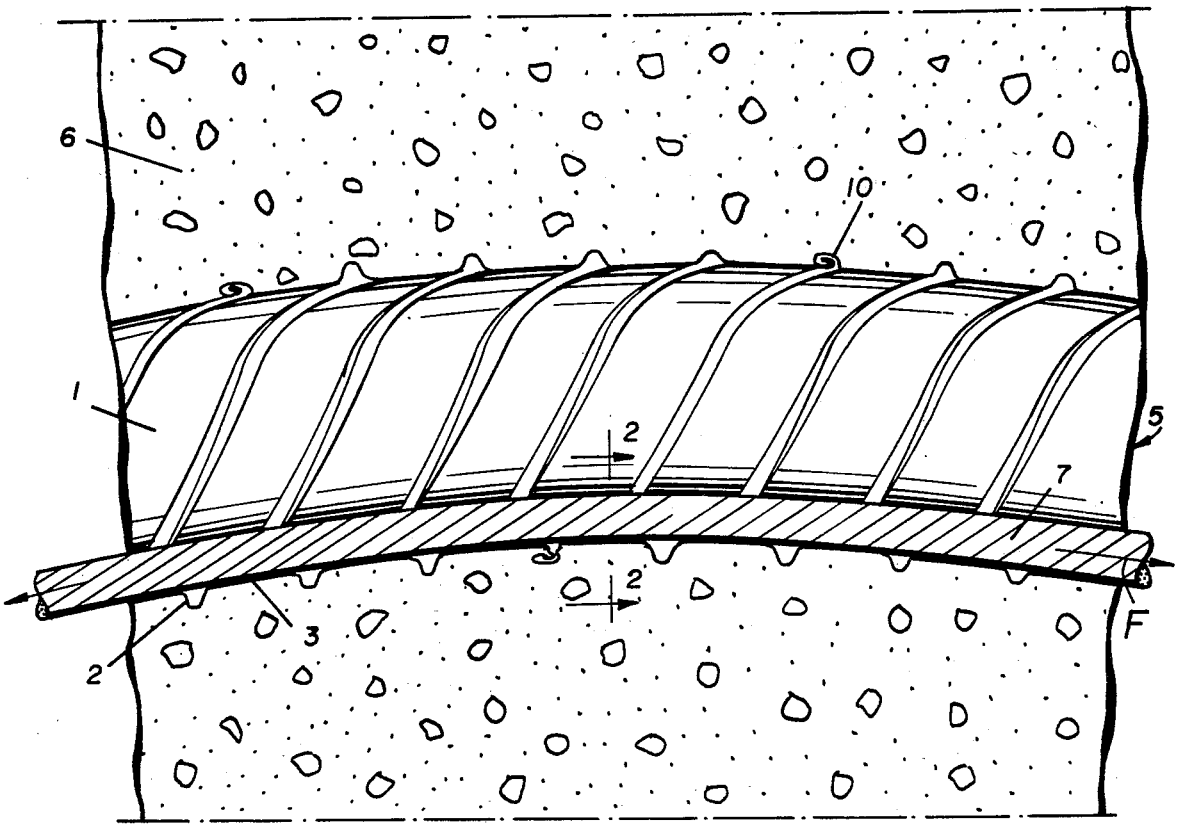

This is a continuation, of application Ser. No. 496,987, filed May 23, 1983, now abandoned.

The invention relates to metal conduits for burying in concrete structures and receiving the cables for prestressing the structures, which cables are subjected to a pulling force with anchorage on said structures at the ends of said conduits.

It also relates to the process for manufacturing these conduits.

It relates more particularly to the case in which the axes of said conduits are not rectilinear and where the pulling forces exerted on the cables are high, which develops high application pressures between the cables and the conduits in the curved zones of these latter.

To promote sliding of the cables along the conduits, i.e. to reduce their mutual friction, and thus to increase the performances (by reducing more especially the pulling forces at the ends of the cable as well as the section of these cables), the application to the inner face of the conduits and/or to the outer face of the cables of an appropriate "lubricating" product has already been proposed, formed more especially by a graphite or molybdenum disulfide powder.

Such a process generally gives satisfaction.

But when the pulling forces exerted on the prestress cables, and so the local application pressures of these cables against the conduits, are very high, destruction and expulsion of the intermediate lubricating layer are sometimes observed.

This is in particular the case when the walls of the conduits are undulating and especially when the cables are formed by strands or bundles of twisted or helically wound wires.

In this case in fact the contact zones between the cables and the conduits are reduced to very small, even practically pin-point surfaces and the local application pressures which result from these surface reductions are all the higher.

Thus, in some recent embodiments, it is not rare for the value of said pressure to reach or even exceed 1000 bars.

The applicant has observed that, to resolve a problem having no connection with the one outlined above, namely to facilitate the overall deformations of wires or similar continuous elements by hot drawing through appropriate dies, previous coating of these wires or tubes has already been proposed by chemically applying to their outer surfaces a coating formed of a metal phosphate layer, itself covered with gelified soap: this coating is so intimately bonded to the surfaces of the elements to be deformed that it is not torn away by the dies and then provides efficient guiding for the deformation.

The previous phosphatation and soaping treatments in question are hardly applicable to inner surfaces of tubes or conduits.

But it so happens that, for manufacturing prestress conduits readily lending themselves to bending, it is particularly advantageous to proceed by helically winding a continuous metal "ribbon" or strip.

Now, the faces of such a strip lend themselves perfectly well to the above treatments.

The invention is essentially characterized in that said phosphatation and soaping treatments, known per se for the outer surfaces of wires to be drawn, are applied to one at least of the two faces of such a strip, after which this strip is helically wound so as to form a conduit whose above treated face forms the inner face.

Experience shows that the sliding contacts formed locally and when cold between the prestress cables and the inner surfaces of the conduits thus formed are provided with excellent lubrication, even for the highest values of the pulling forces exerted on these cables.

The invention comprises, apart from this main arrangement, certain other arrangements which are preferably used at the same time and which will be more explicitly discussed hereafter.

In what follows, a preferred embodiment of the invention will be described with reference to the accompanying drawings, in a way which is of course in no wise limiting.

FIG. 1 of these drawings shows in axial section a bent portion of a prestress conduit formed in accordance with the invention and containing a stretched cable.

Figure 2:
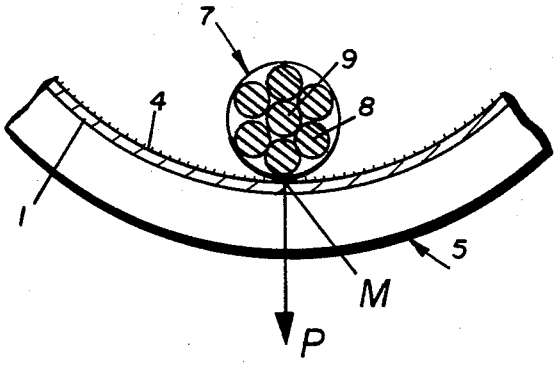

FIG. 2 is a partial cross section of said conduit and said cable along II—II of FIG. 1.

Recourse is had to a soft steel strip 1 deformed in longitudinal undulations, that is presenting an undulating cross section with peaks 2 and hollows 3.

At least the face of strip 1 intended to become the inner face of the conduit is subjected to a chemical treatment known per se leading to the intimate bonding on this face of a phosphate layer covered outwardly with a gelified soap film.

This treatment comprises the succession of following operations, which are all carried out in a tunnel oven heated to a temperature of the order of 70° to 80° C. through which said strip travels at constant speed:

- cleaning with dilute sulfuric (or hydrochloric) acid for about 10 seconds,
- two successive rinsings with water lasting about 3 seconds each, separated by mechanical brushing,
- application by vaporization, for about 70 seconds, of a phosphatation bath formed of combined zinc and iron phosphate, oxidants (chlorates, nitrites, . . . ) and appropriate additives,
- further rinsing with water,
- application by vaporization, for 5 to 6 seconds, of a soap formed by an aqueous solution of sodium stearate and sodium palmitate,
- and finally drying.

Purely by way of indication, the above phosphatation bath could be a 6% by volume aqueous solution of the liquid commercialized by the Compagnie Francaise de Produits Industriels (CFPI) under the name THERMOGRANODINE 63, the soap being then itself formed by an aqueous solution of the powder commercialized by said CFPI company under the name PROLUB.

The above treatment results in applying successively to the treated face of strip 1:

- a crystalline layer having a thickness of the order of 0.5 micron formed of phosphate crystals which have the general shape of palm leaves and are imbricated in the surface crystals of the metal forming the strip,
- then a surface layer of soap whose thickness may be of the order of 100 microns: the largest part of this soap layer may be removed by friction, but not its base, which is formed by a very thin film, of a thickness of about 1/100 micron, in the form of a velvet whose pile is planted on the underlying crystalline layer.

There is shown schematically at 4 in FIG. 2 the coating with "lubricating" property thus applied very intimately to the treated face of the strip 1 and covering this face.

This coating 4 is recognizable from its mat appearance, its light grey color and its oily feel, resembling that of household soap.

Then this strip is wound in helical form so as to obtain a tubular conduit 5 in which said treated face forms the internal face.

This winding is carried out with lateral overlapping of the adjacent turns of the helix so that the peaks 2 form outer helical ribs and hollows 3, helical grooves each joining together two of these ribs.

Then the edges of the overlapping turns are fastened to one another by mutually bending them back one on the other similar to crimping (at 10).

The conduit 5 thus obtained is easy to bend according to the needs of the prestressing.

In FIG. 1 can be seen a concrete structure 6 in which such a bent conduit 5 has been buried, as well as one of the prestress cables 7 positioned in this conduit 5, which cable is subjected to a pulling force F exerted between its two ends.

This cable 7 is formed preferably, as shown, by a plurality of wires or strands 8 helically wound about another wire 9 forming a central core.

Theoretically, the application surface of such a cable 7 against conduit 5 is reduced to a succession of points or pin-point zones M (FIG. 2) which, for each strand, are spaced longitudinally apart from each other by a distance equal to the pitch of the winding helix of the strands, which pitch is generally of the order of 20 cm.

Furthermore, the fact that the contact between each cable and the conduit can only be established in the bottoms of the helical grooves of the conduit corresponding to the above hollows 3 further reduces by so much the possible application surface between cable and conduit.

This double circumstance, combined with the very high values given to force F, leads to the development of local pressures P, themselves extremely high, at the contact points M.

Despite these huge forces, the application of a pulling force to the cables results in the formation of perfectly "lubricated" sliding contacts between these cables and the inner surface of the conduit, i.e. not causing any tearing away of the intermediate phosphated layer in the small contact zones M.

Of course, after this application of a pulling force, the volume inside the conduit between the cables and the inner surface of this conduit is filled with an injected grout filling or a protection grease (not shown) in the usual way.

Following which, and whatever the embodiment adopted, a prestress conduit is finally obtained whose construction and advantages, in particular the possibility of receiving with perfectly lubricated sliding contacts, cables subjected to very high pulling forces, result clearly from what has gone before.

As is evident, and as it follows moreover already from what has gone before, the invention is in no wise limited to those of its modes of application and embodiments which have been more especially considered; it embraces, on the contrary, all variations thereof.

I claim:

1. An elongated continuous tubular conduit for placement in a concrete structure for receiving at least a cable that can be pulled for therein prestressing the concrete structure, said conduit being formed from a single helically wound elongated, metal strip, wherein one face of said metal strip that is to become the interior face of said tubular conduit is intimately coated with a metal phosphate layer, said metal phosphate layer being in turn covered with a soap, said metal strip being subsequently wound and fastened into tubular form with overlapping adjacent turns so that an improved interior surface is created over small areas of which the cable can be slidably pulled.

2. The prestress conduit according to claim 1, wherein said metal strip has an undulating cross-section defined by peak and hollow portions thereby defining helical ribs and grooves in the conduit.

* * * * *